US006808285B2

(12) United States Patent
Shemitz et al.

(10) Patent No.: US 6,808,285 B2
(45) **Date of Patent: *Oct. 26, 2004**

(54) WIREWAY ENCLOSURES FOR LIGHTING SYSTEMS

(75) Inventors: Sylvan R. Shemitz, Woodbridge, CT (US); Paul R. Ford, Orange, CT (US)

(73) Assignee: Sylvan R. Shemitz Designs, Inc., West Haven, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/174,211

(22) Filed: Jun. 17, 2002

(65) Prior Publication Data

US 2003/0026091 A1 Feb. 6, 2003

Related U.S. Application Data

(63) Continuation-in-part of application No. 09/922,957, filed on Aug. 6, 2001, now Pat. No. 6,431,721.

(51) Int. Cl.[7] ..... A47F 11/11

(52) U.S. Cl. ..... 362/125; 362/127; 362/132; 362/133

(58) Field of Search ..... 362/125, 127, 362/132, 133, 221, 236, 260; 108/23, 50.02

(56) References Cited

U.S. PATENT DOCUMENTS

| | | | | |
|---|---|---|---|---|
| 2,341,895 | A | | 2/1944 | Beck |
| D200,658 | S | | 3/1965 | Mehr |
| 4,164,009 | A | | 8/1979 | Maguire, Jr. et al. |
| D261,200 | S | | 10/1981 | Shaw et al. |
| D266,958 | S | | 11/1982 | Gernhardt |
| D268,367 | S | | 3/1983 | Paquette et al. |
| 4,406,379 | A | | 9/1983 | Anderson et al. |
| D278,555 | S | | 4/1985 | Cummings |
| 4,533,981 | A | | 8/1985 | Radek |
| 4,746,309 | A | | 5/1988 | Dürkop et al. |
| 4,747,025 | A | | 5/1988 | Barton |
| D309,793 | S | | 8/1990 | Frattini |
| 4,994,943 | A | | 2/1991 | Aspenwall |
| 5,022,720 | A | | 6/1991 | Fevig et al. |
| D329,104 | S | | 9/1992 | Dieperink |
| D329,920 | S | | 9/1992 | Dieperink et al. |
| D330,090 | S | | 10/1992 | Walter et al. |
| 5,221,138 | A | | 6/1993 | Bostjancic et al. |
| 5,226,719 | A | | 7/1993 | Feidpausche et al. |
| D354,578 | S | | 1/1995 | Houssin et al. |
| 5,508,898 | A | | 4/1996 | McGovern |
| 5,550,725 | A | * | 8/1996 | Shemitz et al. ..... 362/282 |
| D377,990 | S | | 2/1997 | Nakano |
| 5,690,415 | A | | 11/1997 | Krehl |
| 5,758,585 | A | | 6/1998 | Latchinian |
| D397,485 | S | | 8/1998 | Kalthoff |
| 5,873,646 | A | | 2/1999 | Fjaestad et al. |
| D412,592 | S | | 8/1999 | Kowalenko et al. |
| 6,179,434 | B1 | | 1/2001 | Saraiji |
| 6,231,205 | B1 | * | 5/2001 | Slesinger et al. ..... 362/133 |
| 6,431,721 | B2 | * | 8/2002 | Shemitz et al. ..... 362/125 |

FOREIGN PATENT DOCUMENTS

| | | |
|---|---|---|
| GB | 2 157 095 | 10/1985 |
| GB | 2 241 385 | 8/1991 |
| GB | 2 354 117 | 3/2001 |
| GB | 2 358 691 | 8/2001 |
| GB | 2 359 128 | 8/2001 |
| JP | 08148024 | 6/1996 |
| JP | 10214518 | 8/1998 |
| JP | 10223014 | 8/1998 |

* cited by examiner

*Primary Examiner*—Thomas M. Sember
*Assistant Examiner*—John Anthony Ward
(74) *Attorney, Agent, or Firm*—Fish & Neave; Garry J. Tuna

(57) ABSTRACT

Wireway enclosures are provided for use with lighting systems, particularly display lighting systems. The wireway enclosures are dimensioned to enclose luminaire wiring and preferably other types of wiring and at least one electrical component, such as a ballast or transformer. Wireway enclosures include preferably extruded first and second longitudinal portions hinged together to allow access to the inside of the enclosure. Wiring between adjacent luminaires can run conveniently and inconspicuously through nipple connectors connecting adjacent enclosures.

50 Claims, 17 Drawing Sheets

WIREWAY ENCLOSURES FOR LIGHTING SYSTEMS

CROSS REFERENCE TO RELATED APPLICATION

This is a continuation-in-part of commonly assigned U.S. patent application Ser. No. 09/922,957, filed Aug. 6, 2001, now U.S. Pat. No. 6,431,721, which is incorporated by reference herein in its entirety.

BACKGROUND OF THE INVENTION

This invention relates to wireway enclosures for lighting systems. More particularly, this invention relates to wireway enclosures that provide easy access to and concealment of ballast boxes, transformers, wiring, and other lighting components for display lighting systems.

Many known display lighting systems include lighting units held out either above or below displayed objects by cantilever arms secured to display shelving or a nearby structure, such as a wall. The lighting unit typically includes a light source, ballast, reflector, one or more lampholders, and electrical wiring and connectors. Assembling and installing such lighting systems are often both mechanically and electrically tedious and time consuming because of numerous parts, fasteners, and electrical connections. Moreover, such lighting systems typically include bare-lamp strip lights mounted to a mounting board. The strip lights and mounting board are then typically hidden behind a valance board and pass under the cantilever arms. Accordingly, access to electrical wiring and components is cumbersome.

Furthermore, many known display lighting systems ineffectively illuminate objects on display shelving because the light source is typically not set back sufficiently from the shelves. "Setback" is the horizontal distance measured from the outside edge of a shelf to a light source. Sufficient setback permits emitted light to more completely illuminate the vertical faces of displayed objects. Attaining sufficient setback is usually impractical, however, because the obtrusive sizes of the lighting unit, valance, and cantilever arms required to hold the lighting unit and valance add clutter, thus distracting attention away from the displayed objects. One known display lighting system reduced the size of the lighting unit by moving the lamp ballast to one of the supporting arms. However, any benefit provided by the smaller lighting unit was offset by the increased size of the arm. Generally, most display lighting systems reduce the distraction by using lighter (i.e., smaller) arms, which consequently limits the amount of setback possible.

In view of the foregoing, it would be desirable to provide a display lighting system in which luminaires can be easily assembled and installed.

It would also be desirable to provide a display lighting system in which rows of luminaires can be easily wired to a power source with wiring and components that are substantially out of view and easily accessible.

It would further be desirable to provide a wireway enclosure for a display lighting system that conceals from view and provides easy access to wiring and components.

It would still further be desirable to provide a display lighting system in which light sources can be sufficiently setback from a display to provide effective illumination with little distraction.

SUMMARY OF THE INVENTION

It is an object of this invention to provide a display lighting system in which luminaires can be easily assembled and installed.

It is also an object of this invention to provide a display lighting system in which rows of luminaires can be easily wired to a power source with wiring and components that are substantially out of view and easily accessible.

It is a further object of this invention to provide a wireway enclosure for a display lighting system that conceals from view and provides easy access to wiring and components.

It is a still further object of this invention to provide a display lighting system in which light sources can be sufficiently setback from a display to provide effective illumination with little distraction.

In accordance with this invention, a display lighting system for illuminating objects and areas is provided. The system includes at least one luminaire, which includes a lamp housing, a wireway enclosure, and first and second arms. Each arm has first and second ends. The lamp housing includes two endplates, a reflector, and at least one lampholder. The wireway enclosure is dimensioned to include electrical wiring and at least one electrical component, such as a lamp ballast or transformer. The lamp housing is attachable to the arms at the first ends, and the wireway enclosure is positioned between the first and second arms adjacent the second ends.

Wireway enclosures of the invention, which can also be used with lighting systems other than those described herein, preferably have two longitudinal portions hinged together along one edge and removably attachable along another edge to form an enclosed longitudinal structure having open ends. The open ends are covered with sideplates or sidecovers that together with the longitudinal portions form an enclosure having a cavity therein. One of the longitudinal portions hinges open to provide access to the cavity. Both portions are preferably formed by an extrusion process.

In a first preferred embodiment of the display lighting system, the first and second arms at the second ends can be mounted to a structure, such as, for example, display shelving. Furthermore, each arm has a support structure extending outward from the second end that supports the wireway enclosure.

In a second preferred embodiment of the display lighting system, the wireway enclosure can be mounted to a structure, such as, for example, a wall, and the first and second arms at the second ends are attachable to respective sides of the enclosure.

Advantageously, electrical wiring (e.g., power conductors) can be run to adjacent luminaires preferably through nipple connectors connecting adjacent wireway enclosures. Moreover, wiring unrelated to the display lighting system can be run conveniently and inconspicuously through one or more adjacent wireway enclosures. For example, power conductors for electrical outlets on other circuits, emergency lighting circuits, computer lines, telephone lines, and burglar alarm wiring can also be run through wireway enclosures. Also, any necessary system separation barriers can be installed within each enclosure. An embodiment of the wireway enclosure has at least one removable cover to permit access to the interior of the enclosure. These features simplify electrical connections when installing rows of luminaires and keep the wiring out of view.

In addition, by providing a separate wireway enclosure for electrical components and wiring, the lamp housing can be small, permitting small arms to be used to support the housing at sufficient setbacks from objects displayed on shelving. This improves the illumination of the vertical face of the displayed objects, while reducing distraction to the objects caused by the arms and housing.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

The invention provides a display lighting system for illuminating objects preferably displayed on gondola-type shelving. Alternatively, walls, wall-mounted objects, signs, billboards, books, artwork, hospital patient areas, and work areas (such as desks, benches, and assembly lines), for example, can also be illuminated with the invention. The display lighting system can be mounted to display shelving, walls, and other structures. The display lighting system provides primarily task lighting, but can also provide ambient and accent lighting. Each luminaire of the system can effectively (i.e., more completely) illuminate the vertical face of displayed objects. Individual luminaires are easily assembled and installed, and rows of luminaires are easily wired to a power source with easily accessible, yet substantially out of view, electrical components and wiring. The entire system is easily maintained.

Figure 1:
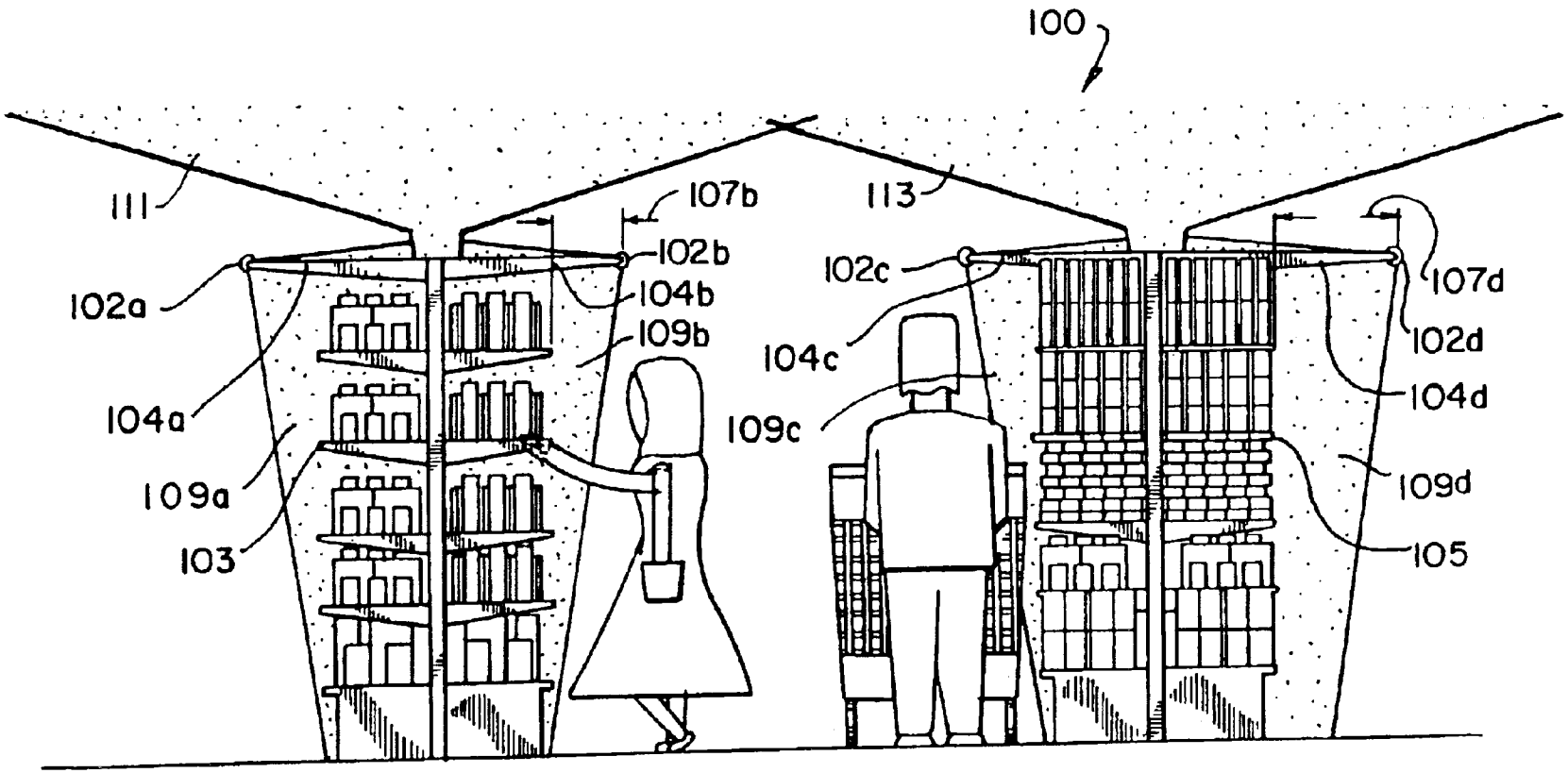
FIG. 1 is a simplified elevational view of a first preferred embodiment of a display lighting system deployed in a retail setting according to the invention.

FIG. 1 shows a first preferred embodiment of a display lighting system deployed in a retail setting in accordance with the invention. Display lighting system 100 advantageously provides what is known as "task-ambient" lighting. System 100 includes at least one luminaire. Each luminaire includes a lamp housing, which provides task lighting. As shown in FIG. 1, lamp housings 102*a–d* are held out and above display shelving 103 and 105 with respective arms 104*a–d*. Lamp housings 102*a–d* are each sufficiently setback from the outside edges of display shelving 103 and 105, as illustrated by setbacks 107*b,d*, to provide more complete illumination (i.e., task lighting 109*a–d*) of the vertical faces of objects on shelving 103 and 105. Setbacks for gondola-type shelving typically range from about 12 inches (30.5 cm) to 18 inches (45.7 cm). However, this can vary depending on the height and spacing of shelves. System 100 also preferably provides optional uplighting 111 and 113 (i.e., ambient lighting).

Figure 2:
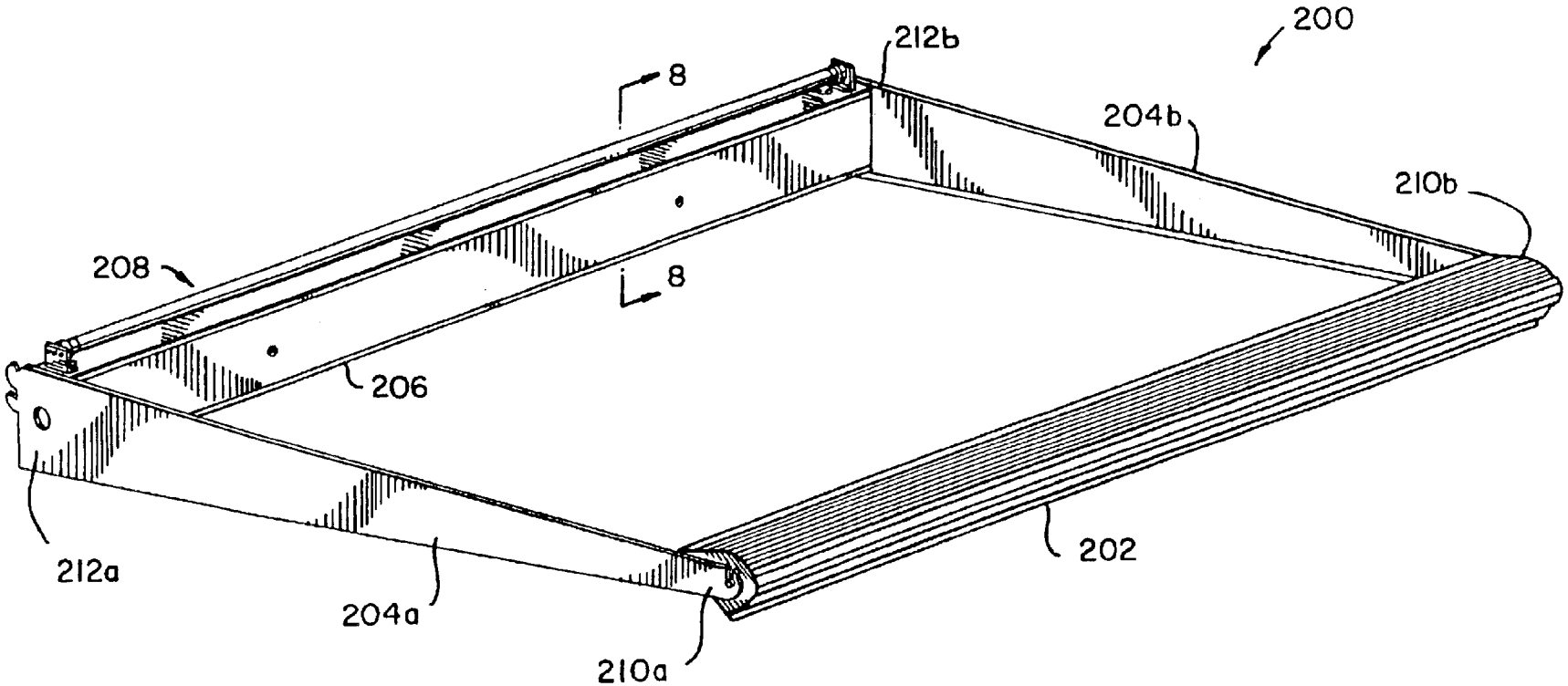
FIG. 2 is a perspective view of a first preferred embodiment of a luminaire of the display lighting system of FIG. 1 according to the invention.

FIG. 2 shows a first preferred embodiment of a luminaire of display lighting system 100 in accordance with the invention. Luminaire 200 includes lamp housing 202, arms 204*a,b*, wireway enclosure 206, and optional uptight unit 208. Each arm 204*a,b* has a respective first end 210*a,b* and a respective second end 212*a,b*. Wireway enclosure 206 is dimensioned to include electrical wiring and at least one electrical component such as a lamp ballast or transformer, and is positioned between arms 204*a,b* adjacent second ends 212*a,b*. The lengths of lamp housing 202 and wireway enclosure 206 preferably are substantially equal.

Figure 3:
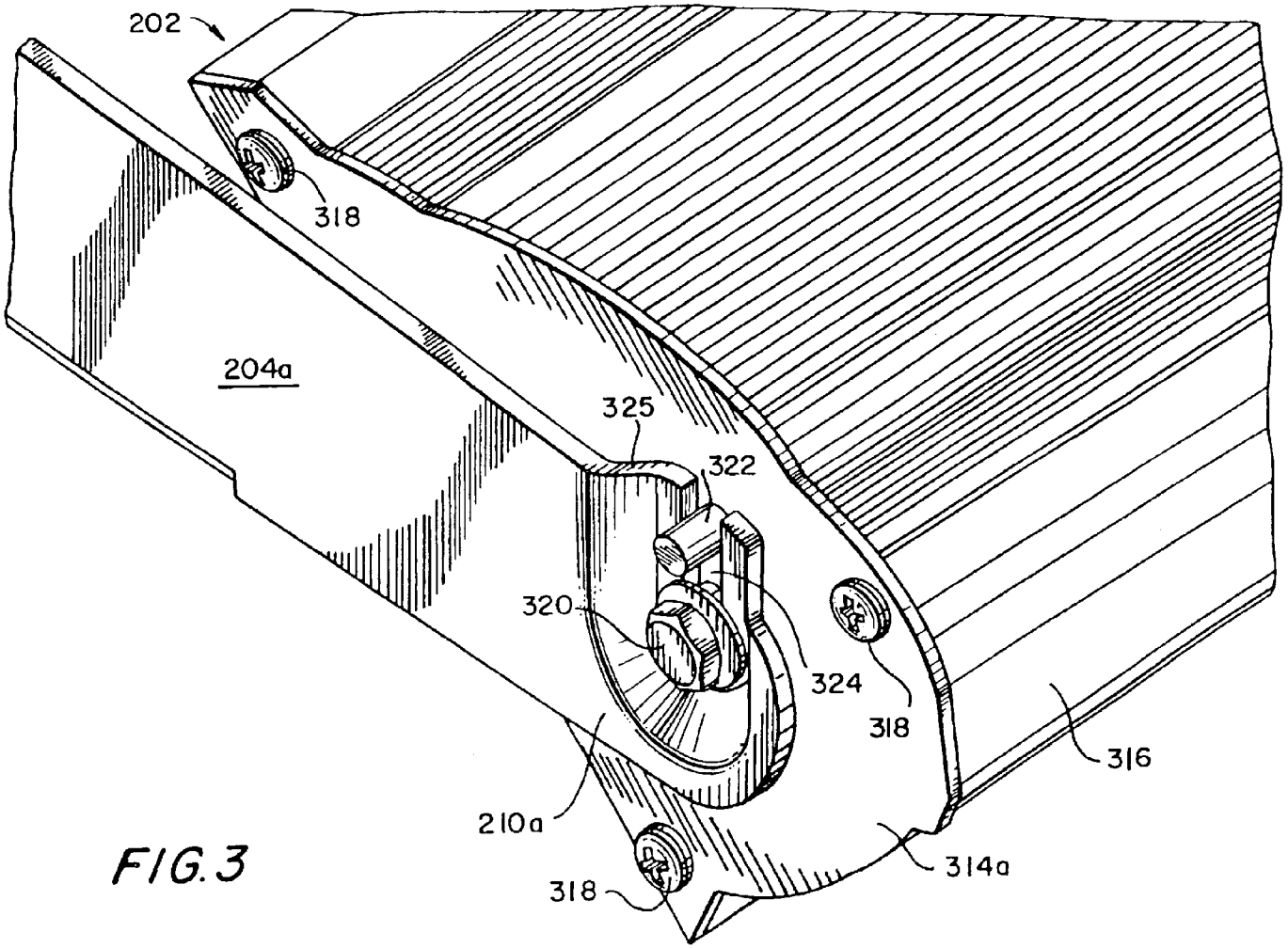
FIG. 3 is a perspective view of a portion of the luminaire of FIG. 2.

As better seen in FIG. 3, lamp housing 202 includes endplates 314*a,b* fastened respectively to each side of reflector 316. While endplate 314*a* is shown fastened to reflector 316 with screws 318, other known methods can be used to fasten endplates 314*a,b* to reflector 316. Alternatively, endplates 314*a,b* and reflector 316 can be integrally formed as a single reflector unit. Also, reflector 316 can be of different cross-sectional sizes or shapes than that shown in FIGS. 2, 3, 9, and 10.

First ends 210*a,b* of arms 204*a,b* are each attachable to respective endplates 314*a,b* preferably with hex-head bolt 320, which may be screwed into a threaded hole, self-clinching nut, or separate nut. Alternatively, other known methods of attaching first ends 210*a,b* to endplates 314*a,b* can be used. The direction in which light is emitted from lamp housing 202 alternatively can be adjustable (i.e., emitted light can be directed upward or downward at various angles) or fixed. If fixed, lamp housing 202 preferably includes pin 322 positioned in slot 324, which sets the direction in which lamp housing 202 emits light, and prevents unintentional movement of lamp housing 202. Furthermore, first ends 210*a,b* each preferably includes a boss 325 that bulges toward the endplate to provide screw head clearance between arms 204*a,b* and screws 318. Boss 325 also allows the outer surfaces of adjacent luminaire arms 204*a,b* to be placed side by side along their entire lengths without interference from bolts 320 or pins 322.

Lamp housing 202 also includes at least one lampholder (not shown) preferably attached to reflector 316. Lampholders, as are known, hold lamps in place and electrically connect them to conductors that deliver power. Lamp housing 202 may include a lens, diffuser, filter, baffle, or other modifier (none shown).

Preferably, lamp housing 202 further includes a T-5 fluorescent lamp (not shown). A T-5 fluorescent lamp has a diameter of about ⅝ inch (1.6 cm) and can have a length of about 46 inches (116.8 cm) (other lengths available). A lamp-length of about 46 inches (116.8 cm) advantageously permits rows of adjacent luminaires 200 to be used with rows of gondola-type shelving, which typically has 48-inch (121.9 cm) units.

Alternatively, other types of fluorescent lamps can be used in lamp housing 202. Also, one or more incandescent lamps of different types or shapes alternatively can be used. For example, a longitudinal array of incandescent lamps can be used. Preferably, incandescent lamps used in housing 202 have axial filaments, such as, for example, certain tubular tungsten halogen and showcase lamps. Also, lamp housing 202 alternatively can include lamps that are single-ended or double-ended.

Lamp housing 202 preferably does not, however, include a lamp ballast or transformer. Accordingly, lamp housing 202 can be of a small preferably slim design, thus presenting less of a distraction to a display than larger lamp housings that include such electrical components.

Arms 204*a,b* preferably are brackets or bracket-like structures that can perform a cantilever function of supporting lamp housing 202 at first ends 210*a,b*. Alternatively, arms 204*a,b* can be of other types of support structures capable of performing the cantilever function, such as, for example, straight, waved, or curved tubular-type members; trusses; perforated plate or sheet metal structures; and very lightweight cantilever arms used with suspension cables. Because lamp housing 202 preferably does not include a lamp ballast or transformer, thus reducing the weight of lamp housing 202, arms 204*a,b* advantageously can be smaller in size and thus less noticeable than those arms supporting lamp housings that include such components. Arms 204*a,b* are therefore less distracting.

Figure 4:
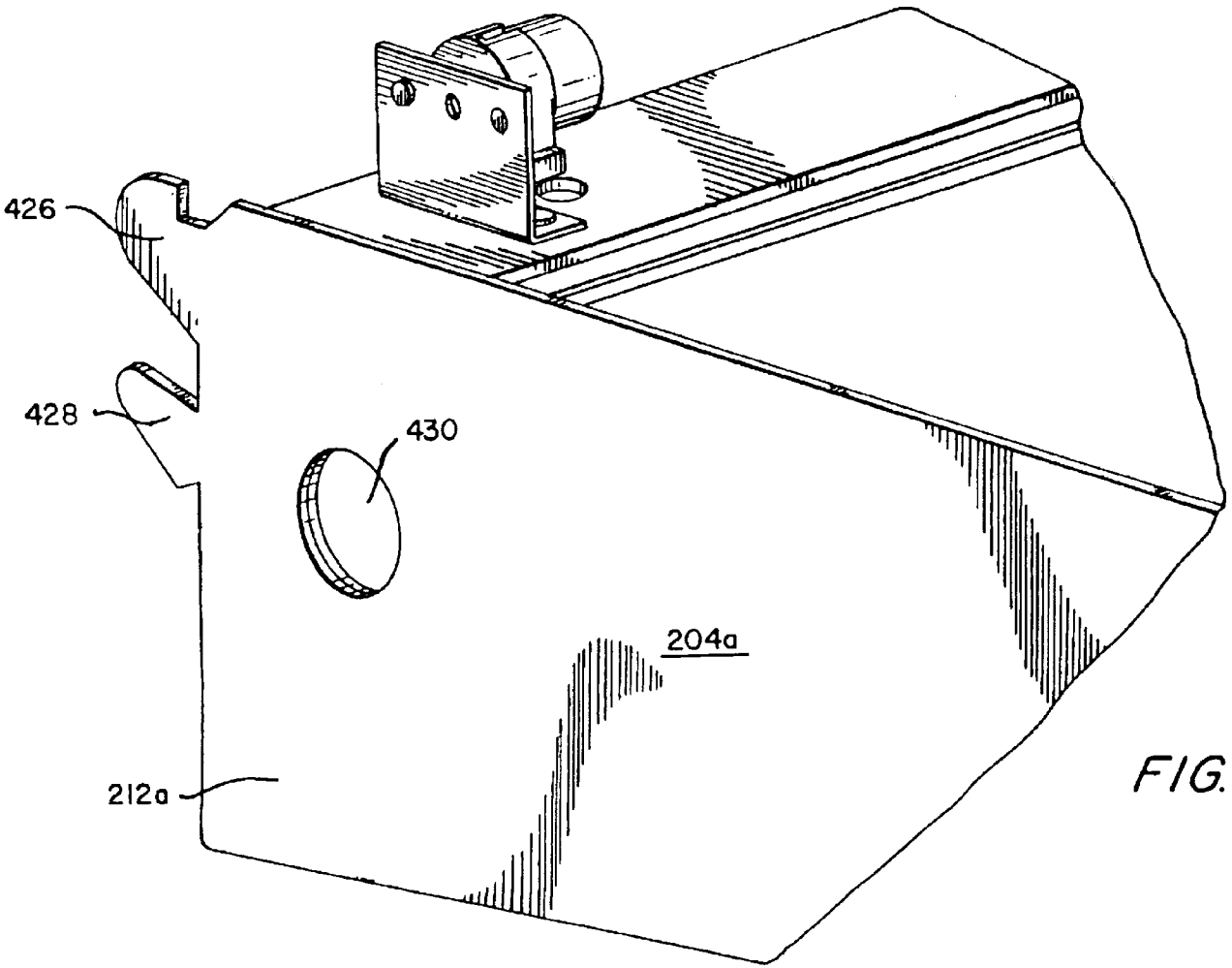
FIG. 4 is a perspective view of another portion of the luminaire of FIG. 2.

Second ends 212*a,b* of arms 204*a,b* can each be mounted to, for example, a respective shelving structure, such as a vertical post. As better seen in FIG. 4, second ends 212*a,b* preferably include notched-tabs 426 and 428. Notched-tabs 426 and 428 are sized and spaced such that they can be inserted and secured within vertical elongated holes common in vertical posts of many shelving systems and other structures. For example, second ends 212*a,b* can be mounted to a workstation cubicle having such elongated holes. Advantageously, second ends 212*a,b* can be mounted without tools or fasteners, thus simplifying and shortening the installation process.

Second ends 212*a,b* each includes at least one hole 430 through which electrical wiring can pass, or through which a nipple connector or other known fitting can be installed to permit electrical wiring to pass, for example, between adjacent wireway enclosures of adjacent luminaires. Alternatively, arms 204*a,b* can be provided with knockouts. As is known, a knockout is a portion of a surface that can be readily removed with usually one or more tools to provide a hole.

Figure 5:
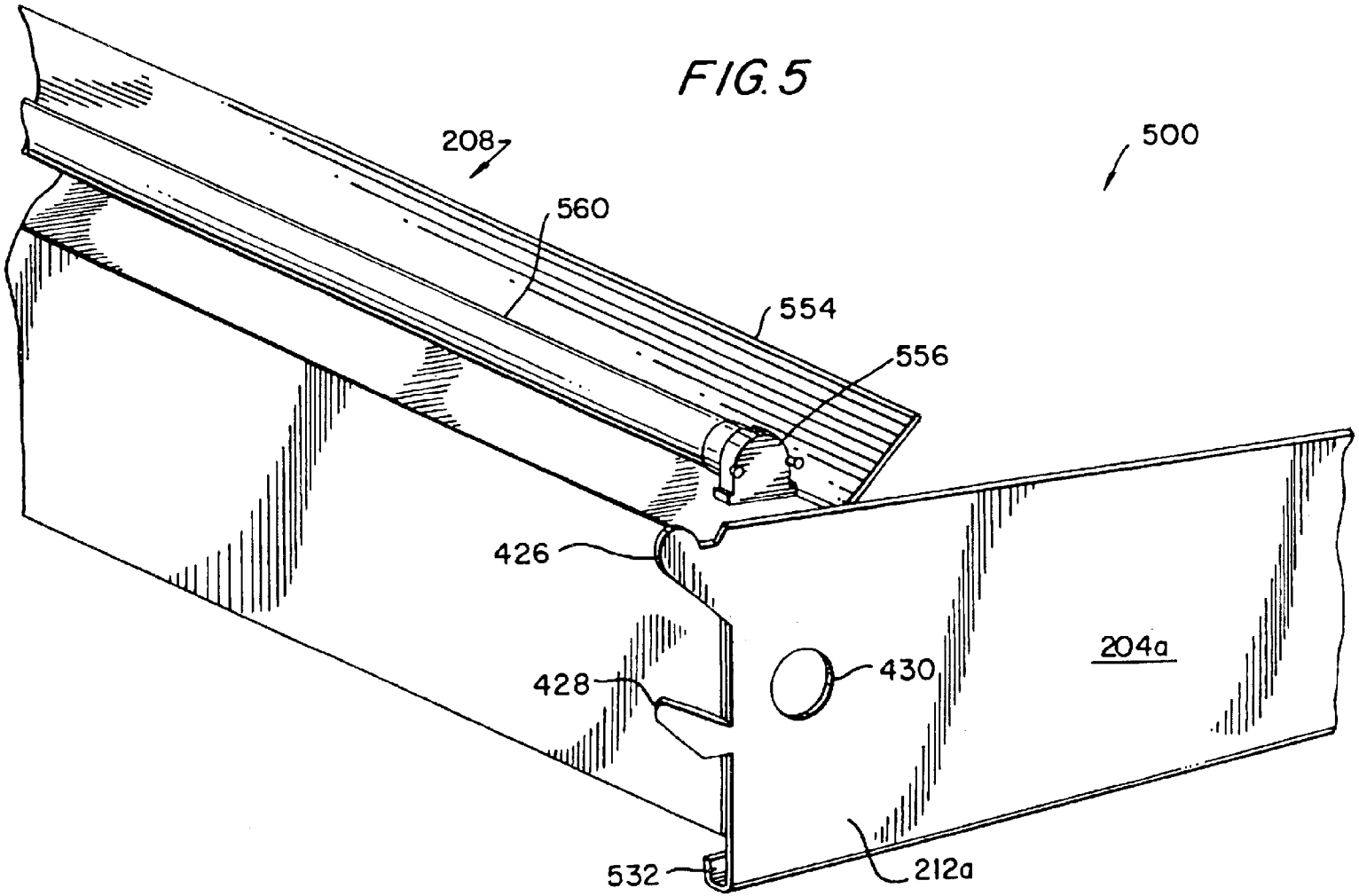
FIG. 5 is another perspective view of the portion of the luminaire of FIG. 4.

At least one arm 204*a,b* preferably has a double-bend trough 532 preferably running along the inside bottom of the arm, as best seen in FIG. 5. Trough 532 inconspicuously carries electrical wiring between wireway enclosure 206 and lamp housing 202. Alternatively, other supporting structures can be used. For example, hook-like structures periodically spaced along the inside of one or both arms 204*a,b* can be used to carry wiring between enclosure 206 and lamp housing 202.

Figure 6:
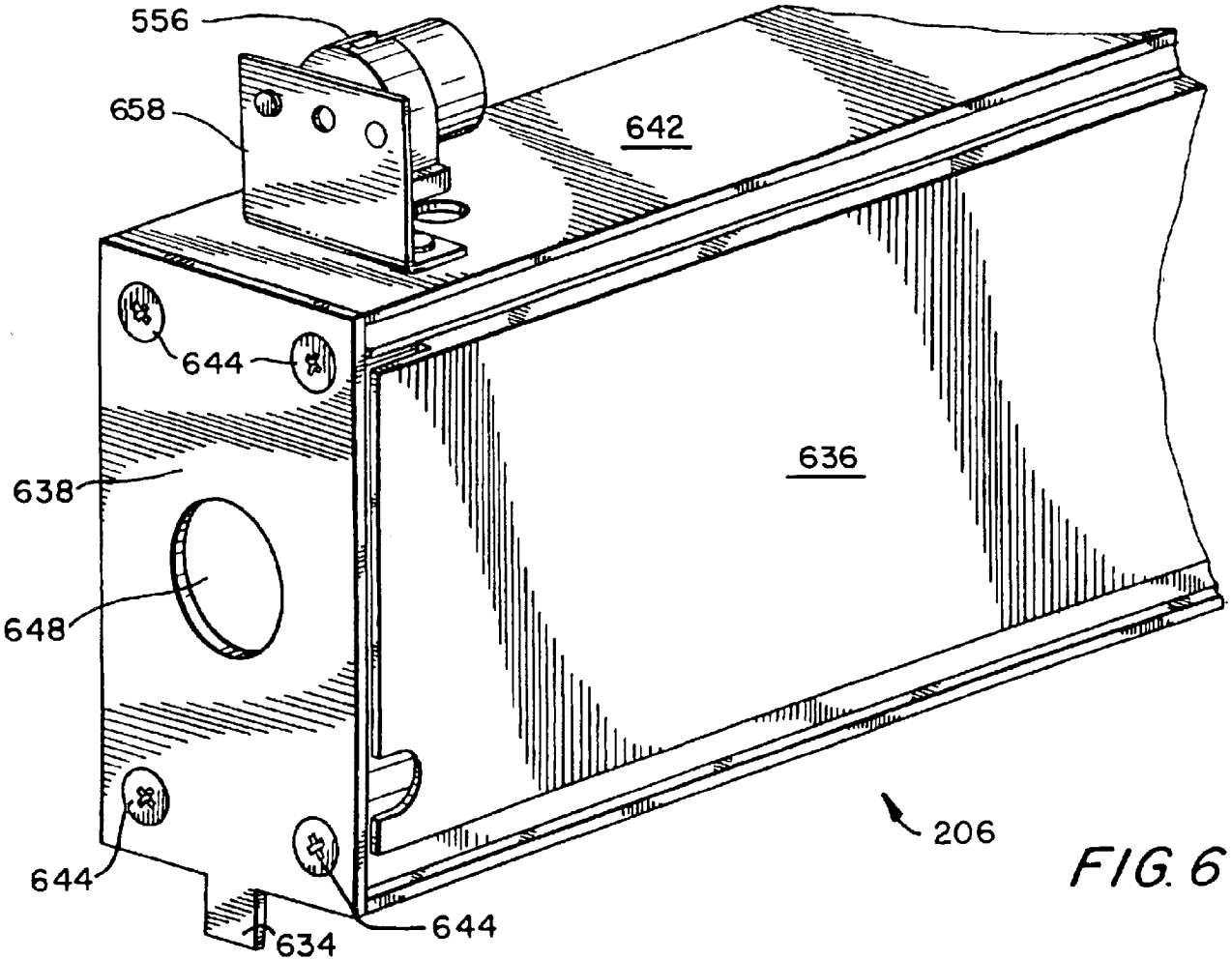
FIG. 6 is a perspective view of a portion of the wireway enclosure of the luminaire of FIG. 2.

Trough 532 preferably is also used to support wireway enclosure 206. As shown in FIG. 6, enclosure 206 preferably has a tab 634 at each longitudinal end that rests inside trough 532 when enclosure 206 is positioned between arms 204*a,b*. Alternatively, other support structures on arms 204*a,b* can be used to support enclosure 206 between arms 204*a,b*. For example, a simple ledge-like structure extending outward from inside an arm 204*a,b* at second end 212*a,b* can be used to support a longitudinal end of enclosure 206.

While shown in FIGS. 1 and 2 to be generally horizontal and parallel to display shelving and displayed objects when installed, arms 104*a–d* and 204*a,b* alternatively can be installed such that they are angled upward or downward with respect to the display shelving or displayed objects.

Figure 7:
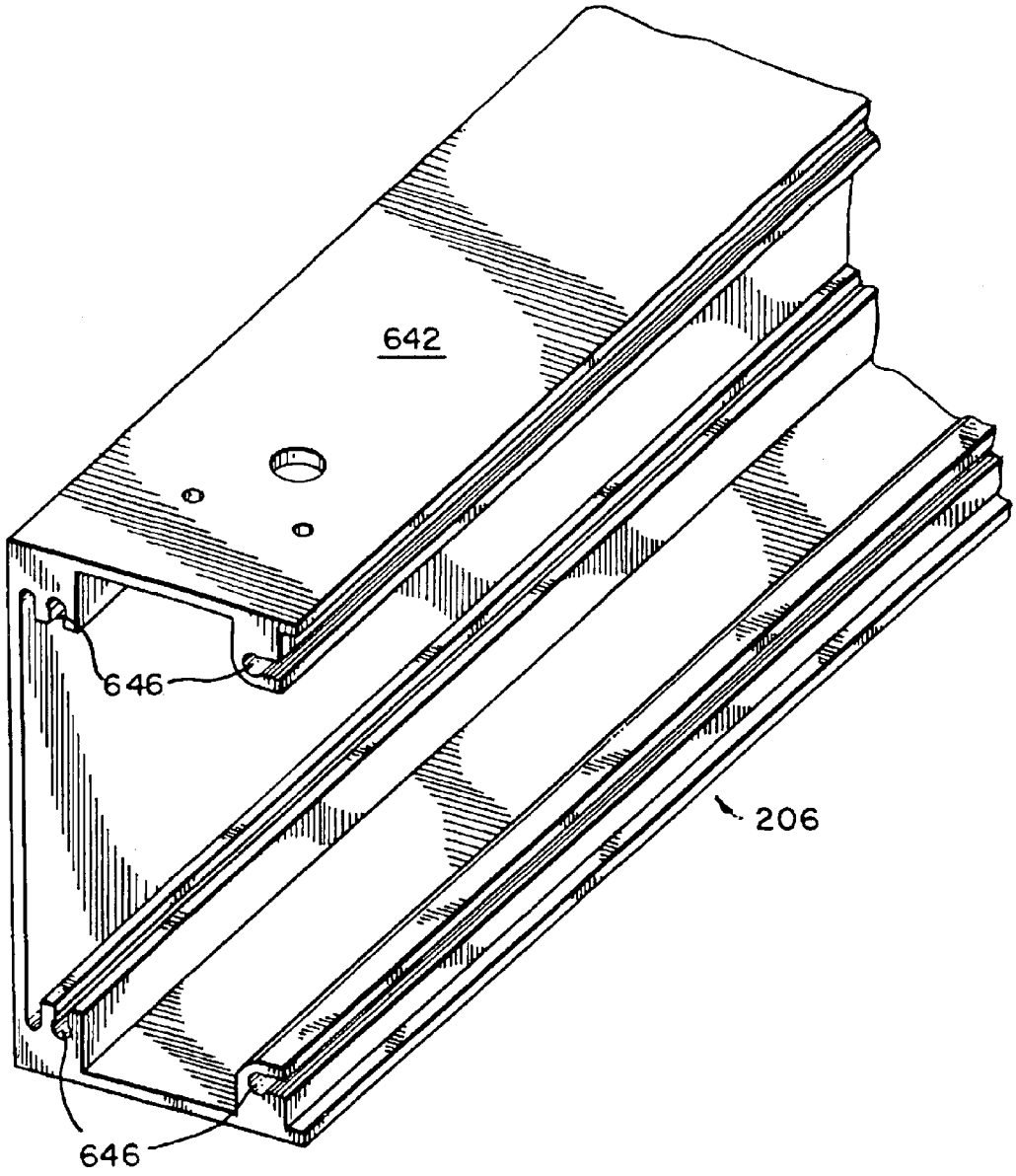
FIG. 7 is also a perspective view of the portion of the wireway enclosure of FIG. 6 with the front cover, sideplate, and optional uptight unit removed.

Referring to FIGS. 6 and 7, wireway enclosure 206 preferably is rectangular (alternatively, other cross-sectional shapes can be used). Preferably, extruded aluminum is used to fabricate enclosure 206, but sheet metal or other appropriate materials can be used instead. Enclosure 206 has a preferably removable front cover 636 and a preferably removable sideplate 638 at each longitudinal end of enclosure 206 (a second preferably removable sideplate 638 is on the longitudinal end of enclosure 206 opposite that shown in FIGS. 6 and 7). Sideplate 638 is attached to enclosure 206 preferably with four screws 644 screwed into respective extruded screw holes or tracks 646. Extruded screw holes 646 advantageously permit long lengths of enclosure 206 to be fabricated, which can then be cut to specified lengths, each cut length having screw holes 646 immediately available. Alternatively, other known methods of attaching sideplate 638 to enclosure 206 can be used. For example, tabs having screw holes at each corner of each longitudinal end of enclosure 206 can be used.

Sideplate 638 includes at least one hole 648 through which electrical wiring can pass, or through which a nipple connector or other known fitting can be installed to permit electrical wiring to pass, for example, between adjacent wireway enclosures of adjacent luminaires. Alternatively, sideplate 638 can be provided with one or more knockouts. Hole 648 can be aligned with hole 430 in an adjacent arm 204*a,b*. Installation of nipple connectors or other known fittings through adjacent pairs of holes 648 and 430 preferably aligns adjacent enclosures.

Figure 8:
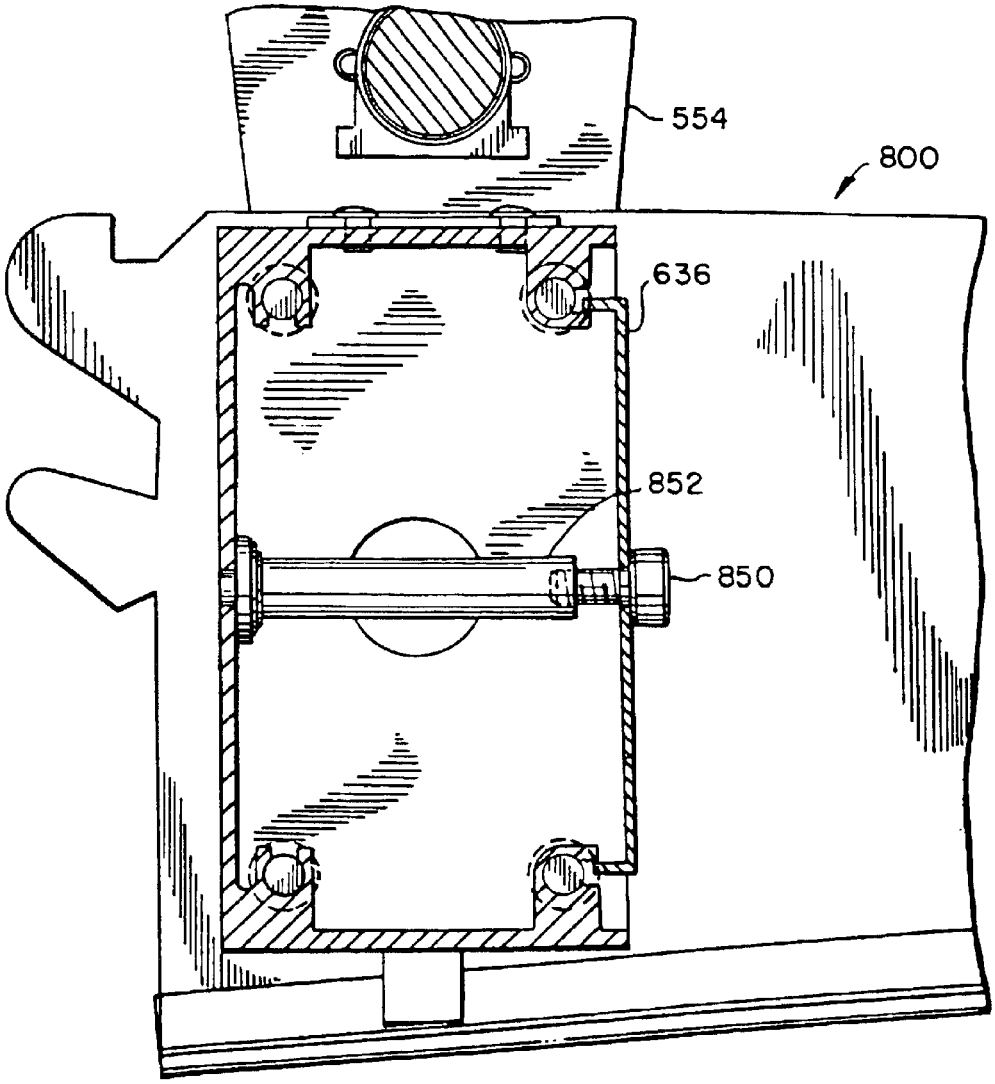
FIG. 8 is a cross-sectional view of a portion of the luminaire of FIG. 2 taken from line 8—8 of FIG. 2.

Removable front cover 636 permits access to the interior of the wireway enclosure. This facilitates installation and connection of electrical components and wiring. Alternatively, or in addition to front cover 636, one or more other sides (e.g., top cover 642) can be removable. Front cover 636 is fastened to wireway enclosure 206 preferably with thumbscrews 850 screwed into threaded standoffs 852, as shown in FIG. 8. Alternatively, other known methods of removably attaching front cover 636 to enclosure 206 can be used (e.g., hinges, friction fit, and tabs with screw holes).

Wireway enclosure 206 is dimensioned to enclose therein electrical wiring and at least one electrical component, such as a lamp ballast or transformer. An individual luminaire or the first luminaire of a row of luminaires can be wired with either "hardwire" or "softwire." Hardwire usually refers to relatively permanent insulated wires in either a flexible or rigid metal conduit. Softwire usually refers to a flexible electric cord such as that with a plug for insertion into an electrical outlet. Softwire is preferable for temporary display lighting in which portability without tools is advantageous.

Wireway enclosure 206 provides display lighting system 100 with increased wiring flexibility, advantageously permitting rows of luminaires 200 to be easily wired. For example, a first luminaire 200 can be connected to a nearby power source. Hardwire power conductors can then be easily run through aligned holes 430 and 648 of adjacent luminaires 200 to connect power to those adjacent luminaires. Furthermore, if advantageous, ballasts or transformers for several adjacent luminaires 200 can be placed in a single enclosure 206 from which electrical wiring can then be run to connect to lampholders in the other luminaires. Removable front cover 636 provides easy access to the interior of each wireway enclosure 206, further facilitating electrical connections.

Moreover, wireway enclosure 206 conveniently provides a wireway for other wiring and any necessary barrier elements (barrier elements separate wires of different systems from each other). For example, power conductors from another circuit can be run through adjacent enclosures 206 to provide electrical outlets along a row of luminaires. Similarly, emergency lighting circuits, telephone lines, computer lines, burglar alarm wiring, and closed-circuit video lines can be easily, conveniently, and inconspicuously run through wireway enclosures, simplifying electrical connections of other equipment.

Luminaire 200 installs easily in several ways. For example, luminaire 200 can be shipped fully assembled, or can be assembled at a job site, and then simply mounted without tools to a shelving structure. Alternatively, arms 204*a,b* can be mounted to a shelving structure, wireway enclosure 206 can be placed between arms 204*a,b* at second ends 212*a,b*, and lamp housing 202 can then be attached to arms 204*a,b* at first ends 210*a,b*. Or still further, arms 204*a,b* can be attached to lamp housing 202 and then mounted to a shelving structure, and wireway enclosure 206 can then be dropped in place between arms 204*a,b* at second ends 212*a,b*. Electrical connections can then be made by removing front cover 636. Power can usually be coupled via conductors in flexible or rigid conduits brought up to luminaire 200 through or adjacent to vertical shelving posts.

Figure 9:
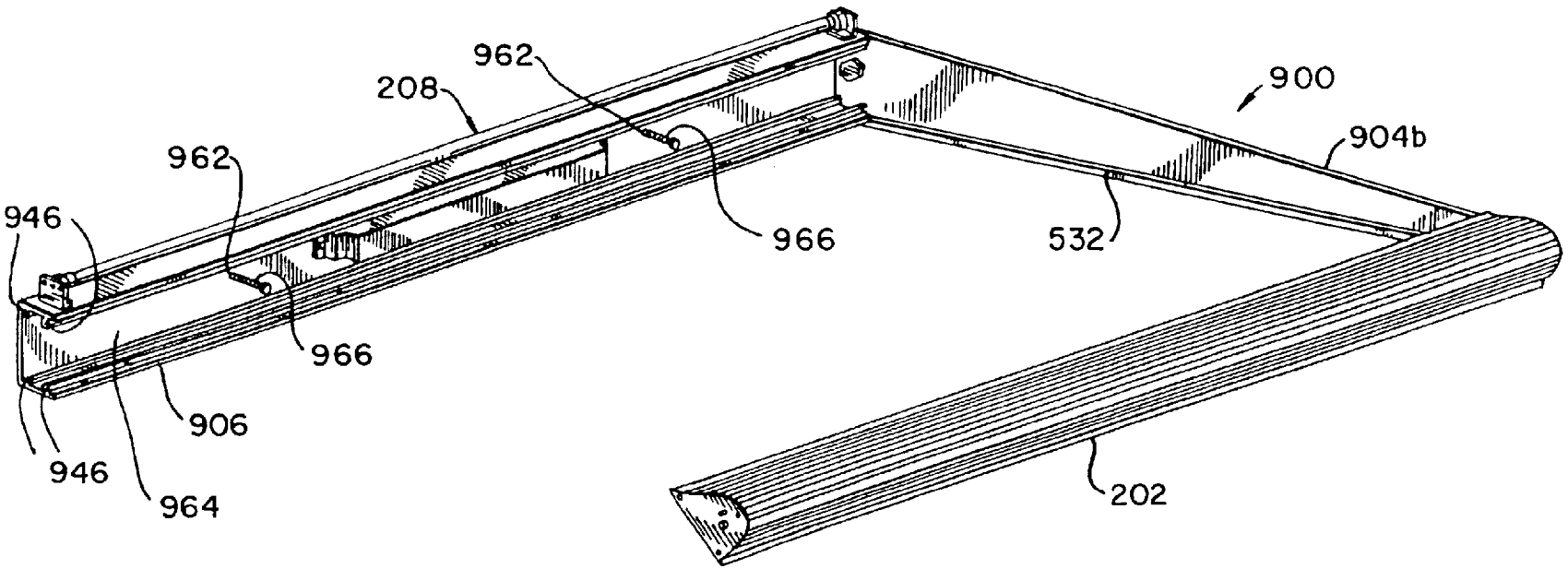
FIG. 9 is a perspective view of a second preferred embodiment of a portion of a luminaire of a display lighting system according to the invention.

FIG. 9 shows a second preferred embodiment of a luminaire of a display lighting system in accordance with the invention. Luminaire 900 includes wireway enclosure 906, shown without a front cover and sideplates, that mounts to a structure (e.g., a wall) located preferably near display shelving or other area or object to be illuminated. Enclosure 906 preferably includes a plurality of predrilled holes 962 in back cover 964 through which preferably a plurality of screws 966 are screwed into anchors set in the structure. The number of screws 966 and location of holes 962 primarily depend on the strength of the material used to fabricate enclosure 906. For example, thinner gauge material will likely require at least one screw and screw hole positioned closer to each longitudinal end of enclosure 906, as well as, perhaps, one or more additional screws and screw holes there between, to prevent torsional twisting of enclosure 906 when arms 904*a,b* are attached. Alternatively, other known methods of mounting enclosure 906 to a structure can be used. For example, enclosure 906 can have notched-tabs (the same as or similar to the notched-tabs of arms 204*a,b*) that can be inserted and secured within elongated holes.

Enclosure 906 preferably does not include sideplates. Arms 904*a,b* (arm 904*a* is not shown for clarity) are attached directly to the longitudinal ends of enclosure 906 with four screws 944 (not shown) screwed into extruded screw holes or tracks 946 (similar to the manner in which sideplate 638 attaches to enclosure 206). Arms 904*a,b* are otherwise similar to arms 204*a,b* and their alternative embodiments. For example, arms 904*a,b* have holes 430 and at least one trough 532, and attach to lamp housing 202 in the same manner as arms 204*a,b*. Arms 904*a,b* may also have notched-tabs 426 and 428.

Similar to luminaire 200, luminaire 900 also installs easily in several ways. For example, luminaire 900 can be shipped fully assembled, or can be assembled at a job site, and then mounted to a structure. Alternatively, wireway enclosure 906 can be mounted to a structure (e.g., a wall), arms 904*a,b* can be attached, and then lamp housing 202 can be attached to arms 904*a,b*. Or further still, arms 904*a,b* can be attached to enclosure 906, the assembly of enclosure 906 and arms 904*a,b* can be mounted to a structure, and then lamp housing 202 can be attached to arms 904*a,b*.

Optional uplight unit 208 provides uplighting and mounts preferably on top of wireway enclosure 206 or 906. As shown in FIG. 5, uptight unit 208 includes a reflector 554, at least one lampholder 556, and a preferably fluorescent lamp 560. Alternatively, one or more incandescent lamps can be used instead of a fluorescent lamp. Lampholder 556 can be mounted directly to a wiring enclosure as shown in FIG. 5, or alternatively, can be preferably mounted to a mounting bracket 658, which is mounted to a wiring enclosure as shown in FIG. 6.

Figure 10:
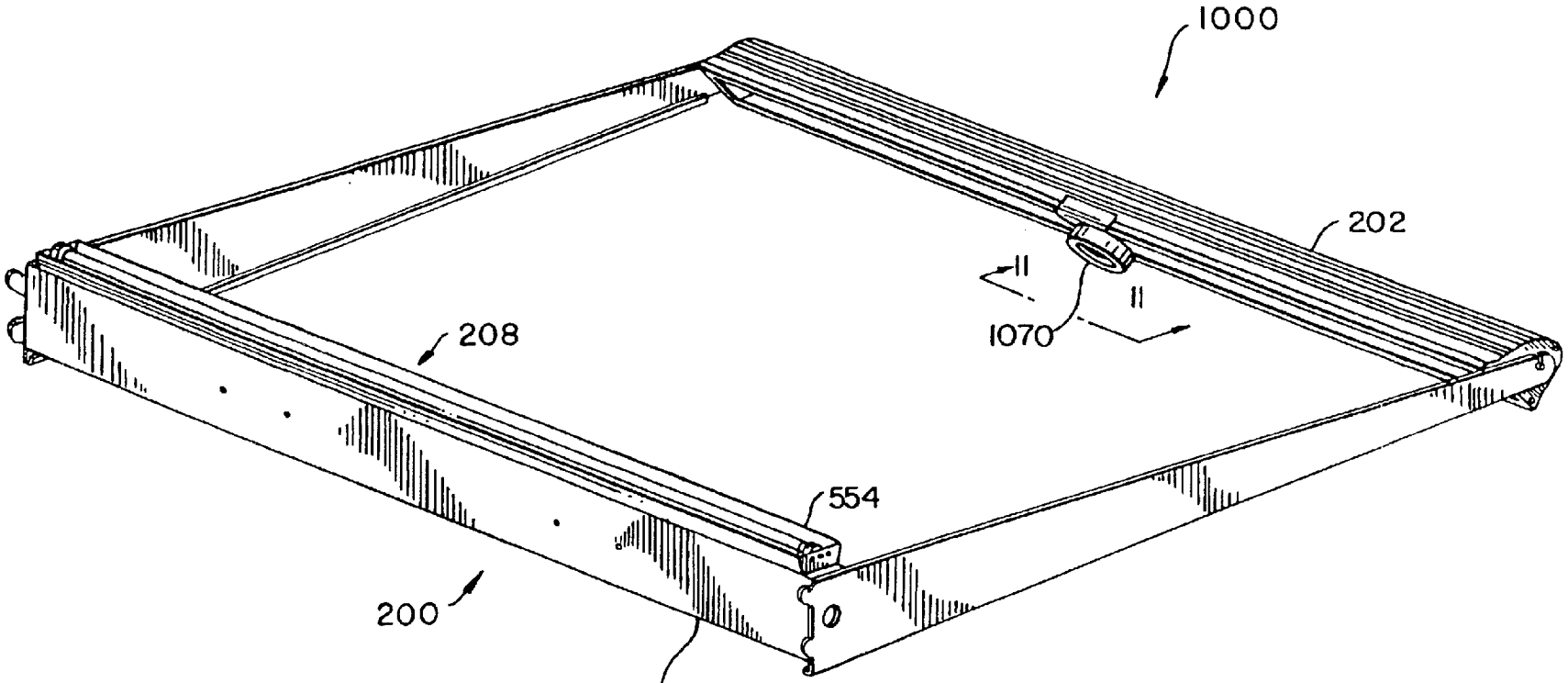
FIG. 10 is a perspective view of the luminaire of FIG. 2 with optional accent lighting according to the invention.

Reflector 554 preferably prevents direct viewing of lamp 560 and reflects emitted light generally upward. As shown in FIG. 5, reflector 554 is one-sided and can be used, for example, with a luminaire mounted to a wall or back-to-back with another luminaire also having an uptight unit 208. Alternatively, reflector 554 can be two-sided, as shown in FIGS. 8 and 10, and can be used, for example, with a luminaire mounted back-to-back with another luminaire having no uplighting. Still further, a luminaire mounted to a wall can have a two-sided reflector 554 that distributes uplighting asymmetrically. The side of reflector 554 closest to the wall is oriented substantially straight up while the other reflector side is flared out as shown in FIG. 5.

FIG. 10 shows luminaire 200 with an optional accent lighting unit 1070 in accordance with the invention. Although shown with luminaire 200, optional accent lighting unit 1070 can also be used with luminaire 900. Accent lighting unit 1070 directs accent lighting to a particular display area or displayed object, and preferably is a low voltage device. A step-down transformer (not shown) coupled to unit 1070 preferably is located in wireway enclosure 206.

Figure 11:
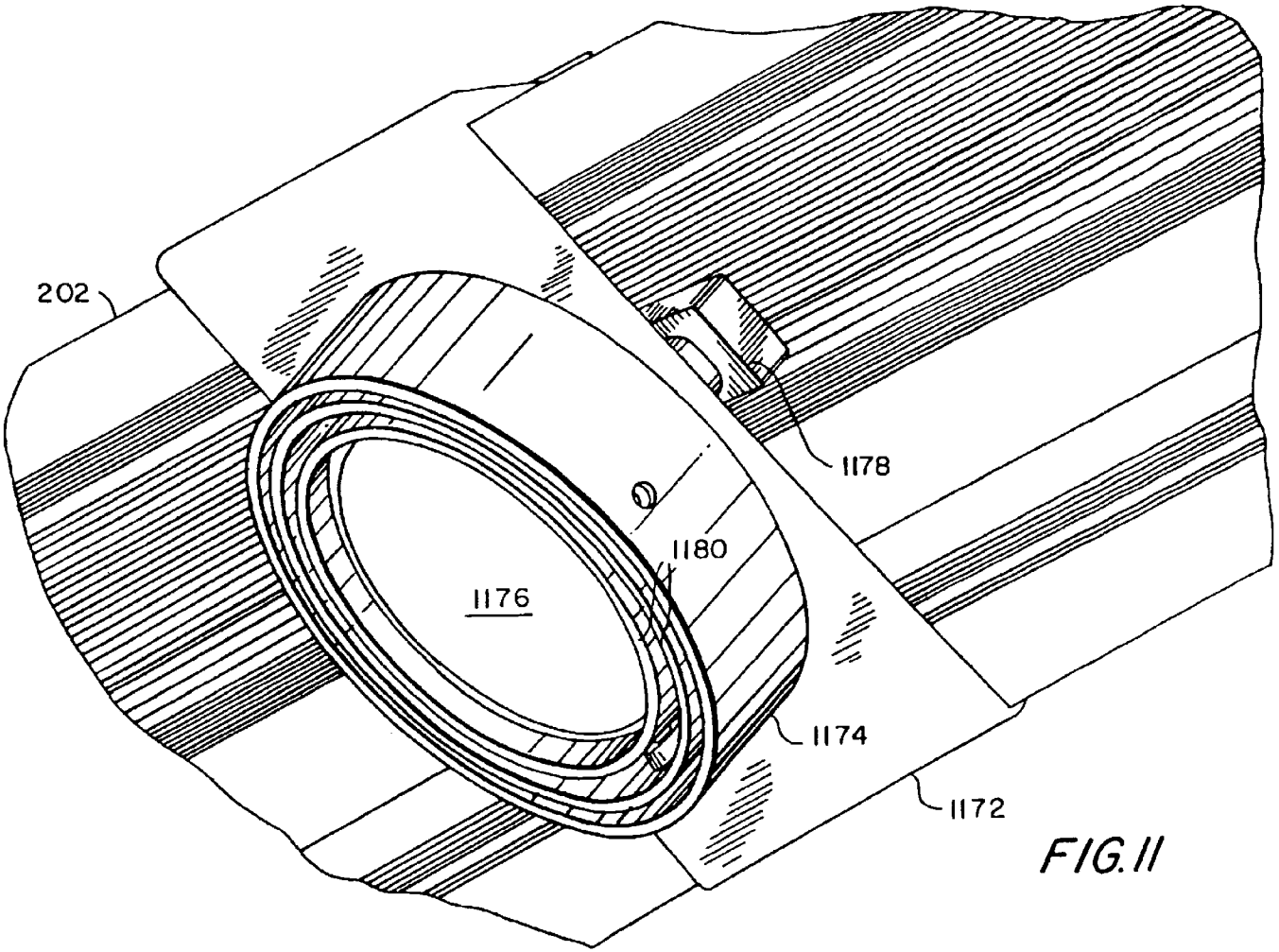
FIG. 11 is a perspective view of a portion of the luminaire of FIG. 10 taken from line 11—11 of FIG. 10.

As shown in FIG. 11, accent lighting unit 1070 includes a preferably stainless steel spring clip bracket 1172 that clips on to lamp housing 202 across the light-emitting side of housing 202. An accent lamp housing 1174 is attached to bracket 1172. Housing 1174 preferably is cylindrical, but alternatively can be of other shapes (e.g., rectangular, oval, and hexagonal). Accent lighting unit 1070 preferably includes an MR-16-type lamp 1176 attached to lampholder 1178. Alternatively, other types of lamps 1176 can be used. Lamp 1176 preferably is held in place by a gimbal-ring mechanism 1180, which is attached to housing 1174. Gimbal-ring mechanism 1180 (known in the art) permits lamp 1176 to pivot preferably about more than one axis. Alternatively, lamp 1176 can be fixedly held in place directly by housing 1174.

Figure 12:
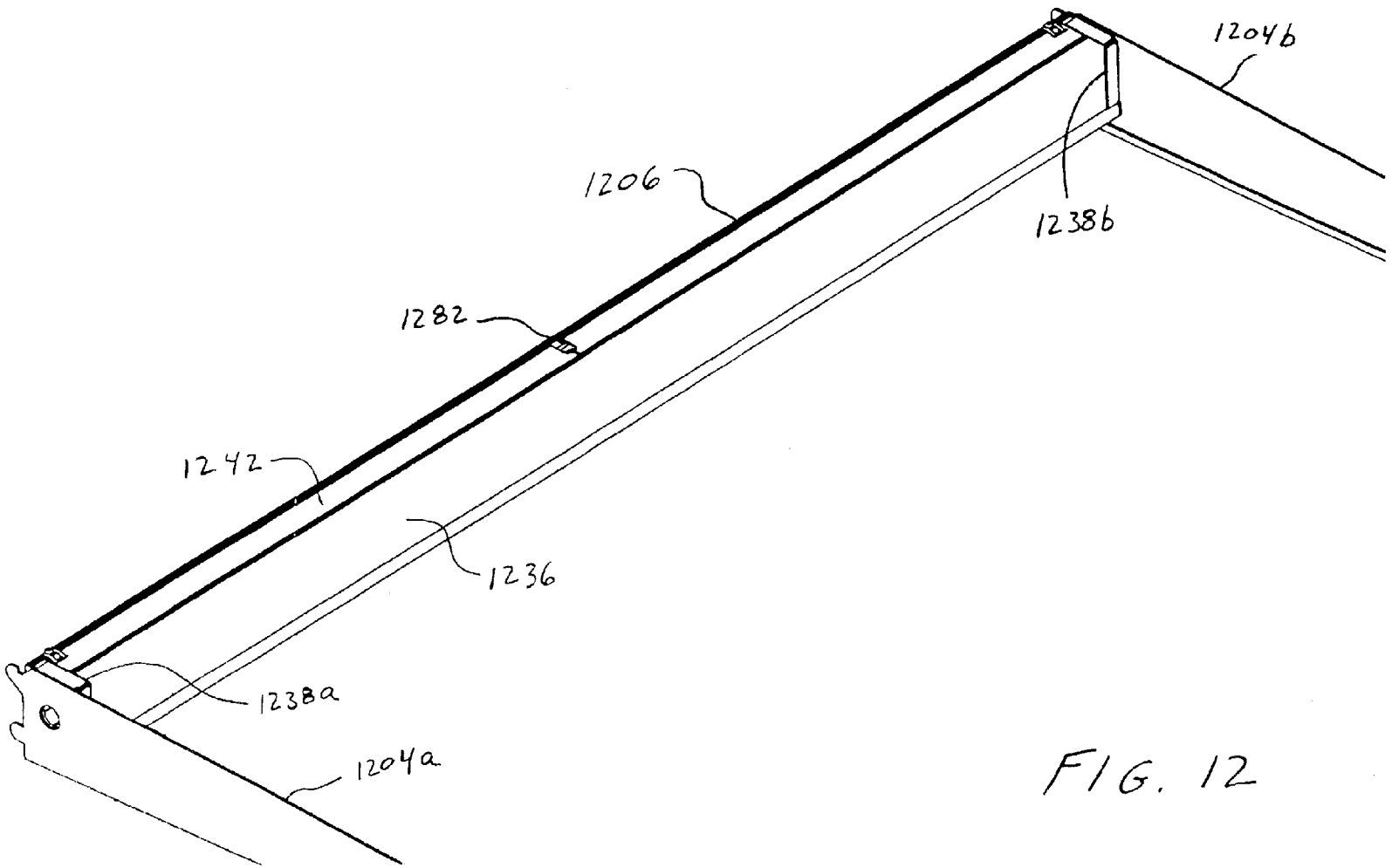
FIG. 12 is a perspective view of another preferred embodiment of a wireway enclosure according to the invention.

FIG. 12 shows another preferred embodiment of a wireway enclosure in accordance with the invention. Wireway enclosure 1206, shown attached to or resting on arms 1204*a,b*, has two sideplates 1238*a,b*, a first one-piece longitudinal portion including an integrally-formed top 1242 and front 1236, and a second one-piece longitudinal portion including an integrally-formed back and bottom. Top 1242 and front 1236 and the back and bottom of enclosure 1206 are preferably formed by an extrusion process, and are preferably extruded aluminum. Together, top 1242 and front 1236, the back and bottom, and sideplates 1238*a,b* form an enclosure having a cavity therein. The enclosure is dimensioned to enclose and substantially conceal from view at least one ballast or transformer and luminaire wiring and preferably other components and other wiring. The longitudinal length of enclosure 1206 can be fabricated to substantially equal a lighting unit held between arms 1204*a,b*. Such a lighting unit can be the same as or similar to lamp housing 202 and includes at least one lampholder and a lamp reflector. For example, enclosure lengths of about 2 feet to about 10 feet can be made. Optionally, top 1242 includes a notch or hole 1282 that can be used with luminaires having, for example, a plug and cord.

Figure 13:
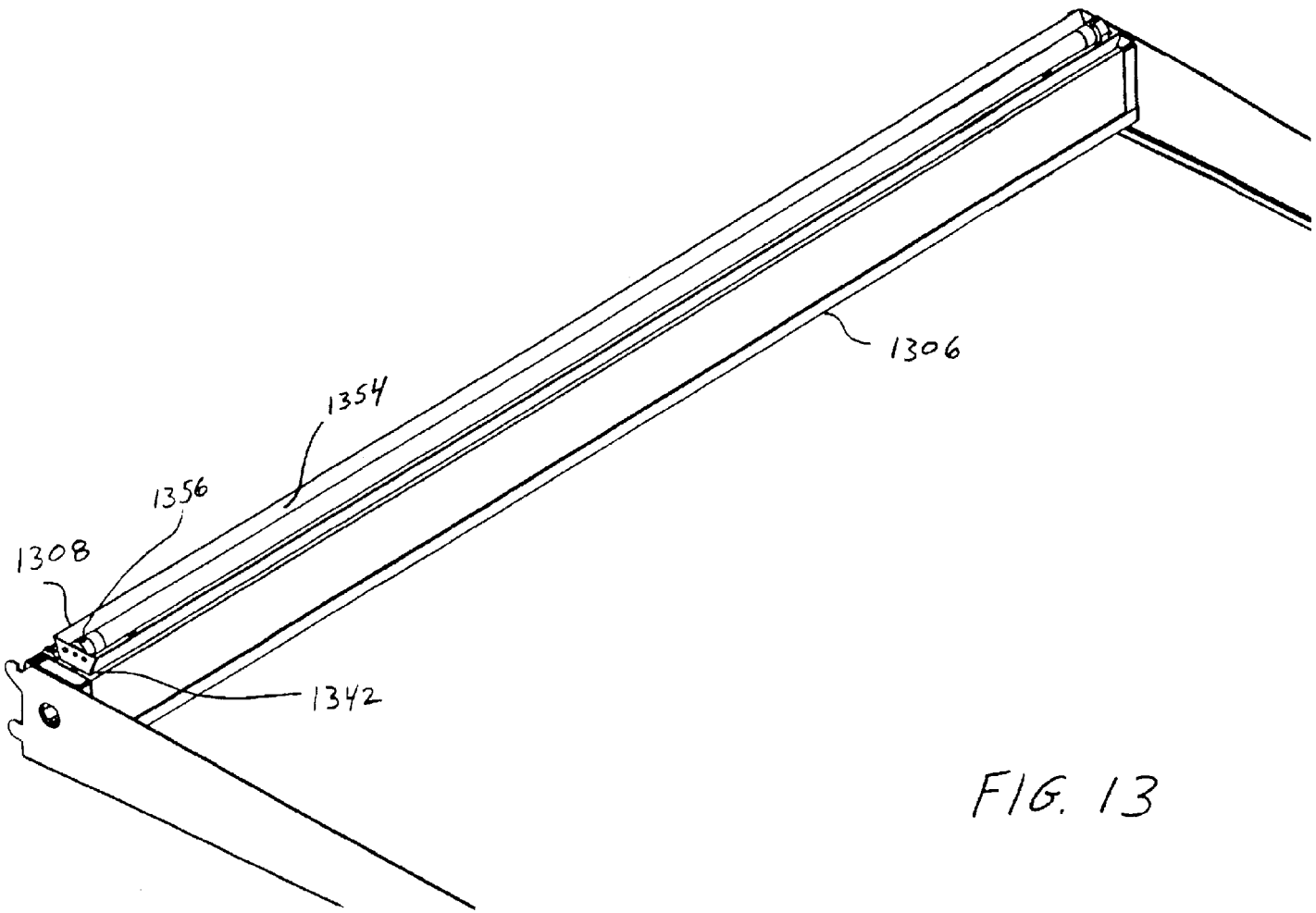
FIG. 13 is a perspective view of a further preferred embodiment of a wireway enclosure according to the invention.

FIG. 13 shows still another preferred embodiment of a wireway enclosure in accordance with the invention. Wireway enclosure 1306, which preferably includes all the characteristics of wireway enclosure 1206, includes lighting unit 1308 mounted on top 1342. Lighting unit 1308 preferably provides uplighting and includes at least one lampholder 1356 and lamp reflector 1354.

Figure 14:
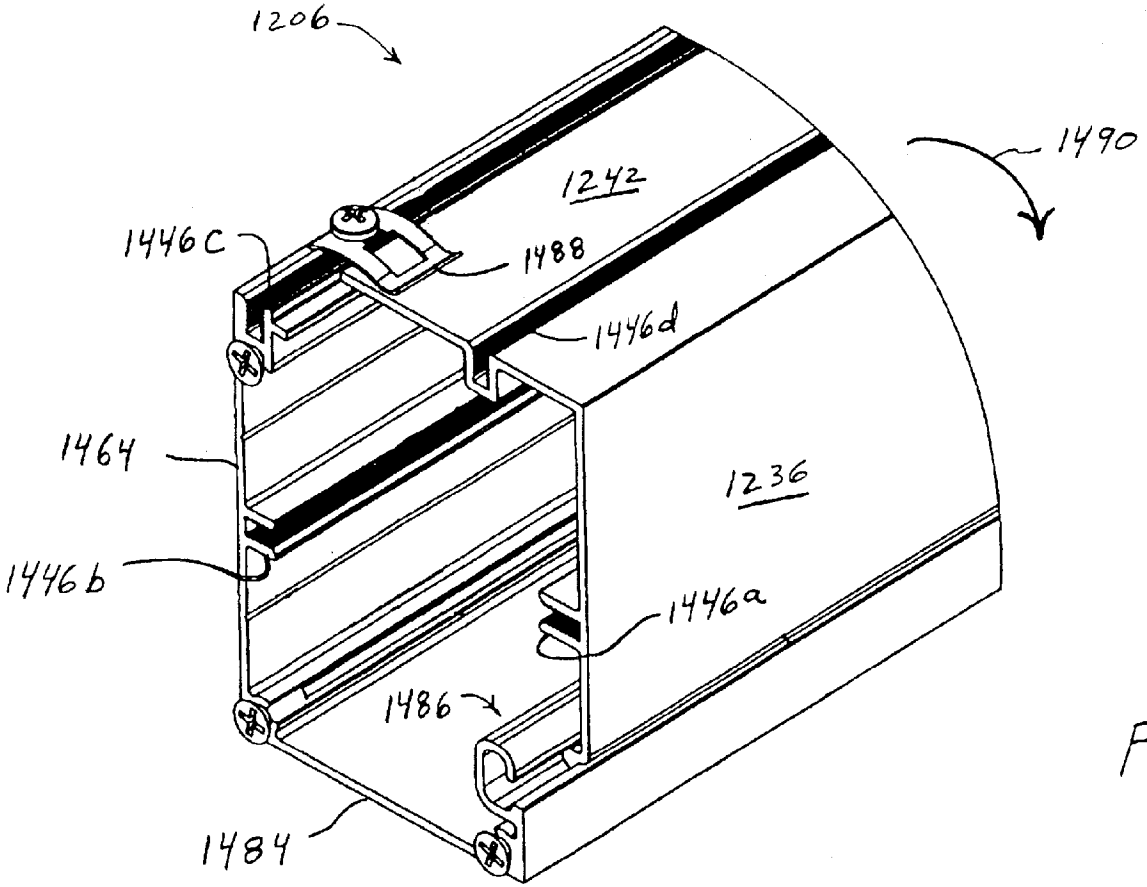
FIG. 14 is a perspective view of a portion of the enclosure of FIG. 12 without the sideplate.

FIG. 14 shows a portion of enclosure 1206 without sideplate 1238. Top 1242 and front 1236 are integrally formed as a single piece and form a substantially 90° angle between them. Back 1464 and bottom 1484 are also integrally formed as a single piece and also form a substantially 90° angle between them. Top 1242 and front 1236 are longitudinally shorter than back 1464 and bottom 1484 in order to accommodate the embodiment of sideplate 1238 described below. Front 1236 is hinged to bottom 1484 at hinge 1486, and top 1242 is removably attachable to back 1464 with clip 1488. Enclosure 1206 and 1306 each have at least two clips 1488, one positioned near each longitudinal end of the enclosure. Alternatively, other types of fasteners or clips can be used to removably attach top 1242 to back 1464. Hinge 1486 allows top 1242 and front 1236 to hinge forward in the direction of arrow 1490 to provide access to the interior of the enclosure. Hinge 1486 is designed such that wires will not be pinched or damaged as the top and front piece is hinged open and closed.

Enclosure 1206 also preferably includes several screw tracks 1446. Screw tracks 1446 are operative to receive and hold fasteners such as screws, and can be used to attach lighting components such as ballasts or transformers to the inside of the enclosure. Front 1236 preferably has a screw track 1446*a* running longitudinally inside of enclosure 1206. Screw track 1446*a* preferably runs the entire longitudinal length of front 1236. Back 1464 also preferably has a screw track 1446*b* running longitudinally inside of enclosure 1206, which also preferably runs the entire longitudinal length of back 1464. Preferably, screw tracks 1446*a* and b run parallel to each other and to top 1242. Back 1464 preferably has a second screw track 1446*c* running longitudinally along its top edge on the outside of enclosure 1206. As shown, this screw track can be used to secure screws holding clips 1488, among other things. Screw track 1446*c* also preferably runs the entire length of back 1464. Top 1242 preferably has a screw track 1446*d* running longitudinally on the outside of enclosure 1206, which preferably runs through the entire longitudinal length of top 1242.

Either or both screw tracks 1446*c* and d can be used to mount lighting unit 1308 to top 1242, thus transforming enclosure 1206 into enclosure 1306. This is advantageous because an enclosure 1206 can easily be converted to enclosure 1306 in the field after enclosure 1206 has been installed.

Figure 15:
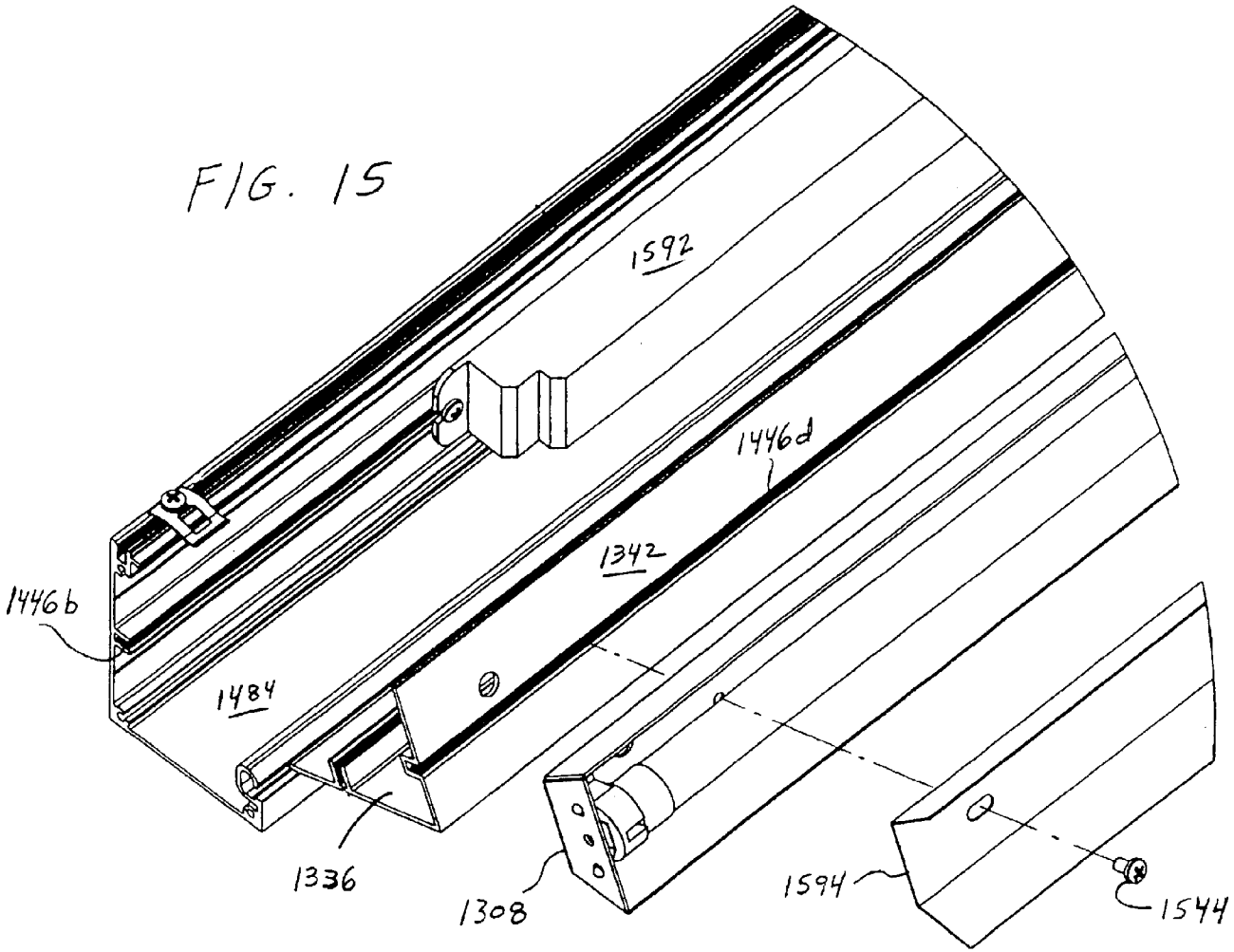
FIG. 15 is an exploded perspective view of a portion of the enclosure of FIG. 13 with the enclosure opened and the sideplate removed.

FIG. 15 shows an exploded view of a portion of enclosure 1306 with top 1342 and front 1336 hinged open to provide easy access to the inside of the enclosure. As shown, a ballast 1592 can be enclosed inside enclosure 1306 using screw track 1446*b*. Lighting unit 1308 can be mounted to top 1342 by using fasteners 1544 (e.g., screws) secured to screw track 1446*d*. Lighting unit 1308 can optionally include a specular insert 1594 for those applications in which, for example, lighting unit 1308 involves non-white surfaces.

Figure 16:
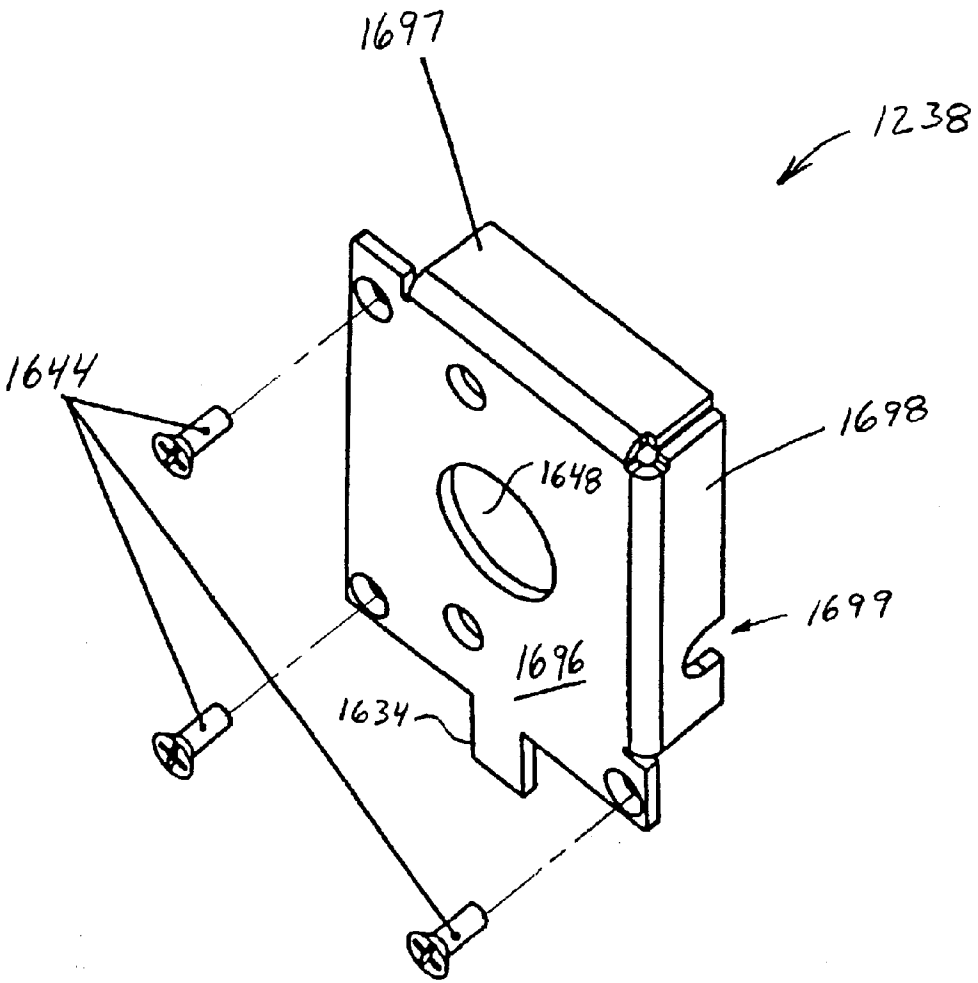
FIG. 16 is a perspective view of a sideplate of the enclosure of either FIG. 12 or 13.

FIG. 16 shows sideplate 1238 in accordance with the invention. Sideplate 1238 can be used with either enclosure 1206 or 1306 and is dimensioned to cover the opening at each longitudinal end of the enclosure formed by the top and front and the back and bottom. Sideplate 1238 can be fabricated from stamped and bent sheet metal or from a zinc or aluminum die casting, and has a preferably flat face 1696 which is substantially perpendicular to the top, front, back, and bottom of the enclosure. Flat face 1696 allows adjacent enclosures to butt against each other without noticeable gaps.

Sideplate 1238 preferably has at least one hole 1648 through which electrical wiring can pass, or through which a nipple connector or other known fitting can be installed to permit electrical wiring to pass, for example, between adjacent wireway enclosures. Alternatively, a knockout can be used in place of hole 1648. Hole 1648 is preferably aligned with hole 430 in an adjacent arm 204*a,b*. Installation of nipple connectors or other known fittings through adjacent pairs of holes 1648 and 430 preferably aligns adjacent enclosures.

Sideplate 1238 preferably also includes top tab 1697 and front tab 1698. When the sideplate is attached to the top, front, back, and bottom of the enclosure, tabs 1697 and 1698 are preferably flush with the top and front of the enclosure, respectively. Front tab 1698 preferably has a cutout 1699 that forms a hole with the front of the enclosure to allow wiring to pass between the inside of the enclosure and, for example, a lamp housing. The wiring can be routed along, for example, an arm attached to both the enclosure and the housing, as described earlier. A tab 1634 similar to or the same as tab 634 is preferably also provided with sideplate 1238.

Sideplate 1238 is preferably fastened to back 1464 and bottom 1484 with fasteners 1644 (e.g., the three screws shown in FIG. 16). Alternatively, sideplate 1238 can be fabricated with additional tabs along its back and bottom (not shown) to be friction fit over the side edges of the bottom and back of the enclosure.

Figure 17:
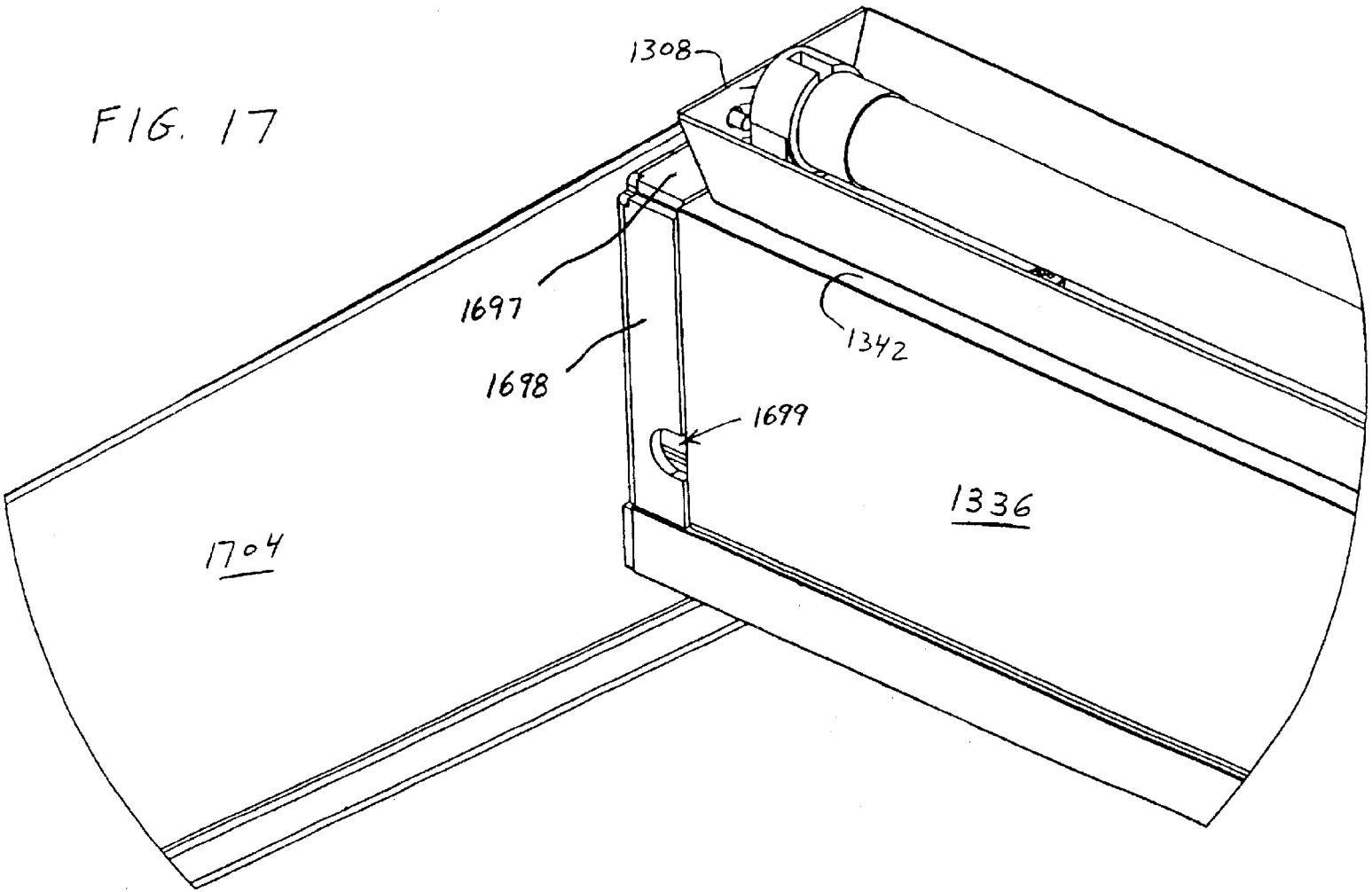
FIG. 17 is a perspective view of a portion of the enclosure of FIG. 13.

FIG. 17 shows a portion of enclosure 1306 and an arm 1704. Note the substantially flush fit of tabs 1697 and 1698 with top 1342 and front 1336, respectively. Also note the hole formed by cutout 1699 that can be used to route wire inconspicuously to and from the enclosure along arm 1704.

Although shown as generally rectangular in shape, wireway enclosures of the invention can be of other shapes, such as, for example, cylindrical, triangular, pentagonal, and so on, and need not be necessarily longitudinal.

Also, although sideplate 1238 is shown, wireway enclosures of the invention can have other types of sidecovers to enclose or cover the open longitudinal ends of the enclosures formed by the first and second portions (e.g., the top and front and the back and bottom). For example, alternative to flat faces, sidecovers can have curved or rounded faces. Further, they need not have top and front tabs 1697 and 1698, in which case the first portion (e.g., the top and front) of the enclosure is preferably the same longitudinal length as the second portion (e.g., the back and bottom) of the enclosure.

Thus it is seen that a display lighting system is provided that assembles and installs easily, and more completely illuminates the vertical face of displayed objects. One skilled in the art will appreciate that the present invention can be practiced by other than the described embodiments, which are presented for purposes of illustration and not of limitation, and the present invention is limited only by the claims which follow.

We claim:

1. A wireway enclosure for a lighting system, said enclosure comprising:

a longitudinal first portion;

a longitudinal second portion hinged to said first portion wherein said first and second portions form an enclosed longitudinal structure having two open ends in a first hinged position; and first and second sidecovers, each said sidecover dimensioned to cover a respective said open and; wherein:

said first and second portions and said first and second sidecovers together form an enclosure having a cavity therein;

said first and second portions provide access to said cavity in a second hinged position;

said first portion has a screw track running longitudinally inside of said enclosure; end said second portion has a screw track running longitudinally inside of said enclosure.

2. The enclosure of claim 1 wherein said enclosure is substantially rectangular.

3. The enclosure of claim 1 wherein said enclosure is substantially cylindrical.

4. The enclosure of claim 1 wherein said first and second portions are formed by an extrusion process.

5. The enclosure of claim 1 wherein said first portion is longitudinally shorter than said second portion.

6. The enclosure of claim 1 wherein said first portion forms a top and a front of said enclosure, said top and said front forming a substantially 90° angle between them.

7. The enclosure of claim 1 wherein said second portion forms a bottom and a back of said enclosure, said bottom and said back forming a substantially 90° angle between them.

8. The enclosure of claim 1 wherein said first portion has a screw track running longitudinally on the outside of said enclosure.

9. The enclosure of claim 1 wherein said first portion has a lighting unit mounted thereon on the outside of said enclosure, said lighting unit comprising at least one lampholder and a lamp reflector.

10. The enclosure of claim 1 wherein said first and second sidecovers each has a hole therein through which wiring can pass.

11. The enclosure of claim 1 wherein said first and second sidecovers are each fastened to a respective longitudinal end of said second portion.

12. The enclosure of claim 1 wherein said sidecovers have a flat face.

13. The enclosure of claim 1 wherein said sidecover have a rounded race.

14. The enclosure of claim 1 wherein said enclosure has a longitudinal length substantially equal to a lighting unit to which said enclosure can be attached via first and second arms at respective longitudinal ends of said enclosure, and lighting unit comprising at least on a lampholder and a lamp reflector.

15. A wireway enclosure for a lighting system, said enclosure comprising:

one-piece top and front;

a one-piece bottom and back, said bottom hinged to said front and said top removably attachable to said back; and first and second sideplates; wherein:

said top and front, said bottom and back, and said first and second sideplates together form an enclosure having a cavity therein;

said first sideplate encloses a longitudinal end of said enclosure and said second sideplate encloses the opposite longitudinal end of said enclosure, said first and second sideplates substantially perpendicular to said top and front and to said bottom and back, said top and front hinge forward to provide access to the inside of said enclosure; and said back and said front each has a screw track running longitudinally inside of said enclosure, said back and said front screw tracks are each operative to receive and hold fasteners.

16. The enclosure of claim 15 further comprising a lighting unit mounted on said top on the outside of said enclosure, said lighting unit comprising a least one lampholder and a lamp reflector.

17. The enclosure of claim 15 wherein said top has a screw track running longitudinally on the outside of said enclosure.

18. The enclosure of claim 17 wherein said top screw track runs through substantially the entire longitudinal length of said top.

19. The enclosure of claim 17 further comprising a lighting unit fastened to said top screw track via fasteners, said lighting unit comprising at least one lampholder and a lamp reflector.

20. The enclosure of claim 15 wherein said back and front screw tracks run substantially parallel to each other and to said top.

21. The enclosure of claim 15 wherein said back has a screw track running longitudinally along its top edge on the outside of said enclosure.

22. The enclosure of claim 15 wherein said back screw track runs through substantially the entire longitudinal length of said back; and and front screw track run, through substantially the entire longitudinal length of said front.

23. The enclosure of claim 15 wherein said top and front and said bottom and back are each formed by an extrusion process.

24. The enclosure of claim 15 wherein said top and front and suit bottom and back are each formed from extruded aluminum.

25. The enclosure of claim 15 wherein said first and second sideplate each has a hole therein through which wiring can pass.

26. The enclosure of claim 15 wherein said first and second sideplates has a knockout therein removable to form a hole through which wiring can pass.

27. The enclosure of claim 15 wherein said first and second sideplates are each attached to said bottom and back via fasteners.

28. The enclosure of claim 15 wherein said first and second sideplates are dimensioned to be friction fit over longitudinal side of said bottom and back.

29. The enclosure of claim 15 wherein said fasteners comprise screws.

30. The enclosure of claim 15 wherein said first and second sideplates each have a front tab adjacent to and substantially flush with said front, said front tab having a cutout for routing wiring there through.

31. The enclosure of claim 15 wherein said enclosure is dimensioned to enclose and substantially conceal from view at least one ballast or transformer and at least luminaire wiring.

32. A lighting system comprising:

a lamp housing comprising:

first and second endplates, a reflector attached to said first and second endplates, and at least one lampholder attached to said reflector;

an enclosure comprising:

a longitudinal first portion, a longitudinal second portion hinged to said first portion, and first and second sidecovers, said first and second portions and said first and second sidecovers together forming an enclosure having a cavity dimensioned to enclose therein wiring and at least one ballast or transformer, said first portion hingeable forward to provide access to said cavity; and first and second arms each having first and second ends, each said arm attached at said first end to a respective one of said first and second endplates and attached at said second end to a respective one of said first and second sidecovers.

33. The system of claim 32 wherein:

said first and second arms each has at least one hole at said second end through which wiring can pass; and said first and second sidecovers each has at least one hole through which said wiring can pass, each said sidecover hole aligned with said hole in said respective second end.

34. The system of claim 32 further comprising a second said enclosure, said enclosure further comprising a connector installed between said two enclosures, said connector allowing wiring from one said enclosure to pass through to the other said enclosure.

35. The system of claim 34 wherein installation of said connector aligns said two enclosures longitudinally.

36. A display lighting system comprising at least one luminaire, said luminaire comprising:

a lamp housing comprising a reflector, said lamp housing having two sides opposite each other;

first and second arms each having first and second ends, each said arm attached at said first end to a respective side of said lamp housing; and an enclosure positioned between said first and second arms adjacent said second ends, said enclosure dimensioned to enclosure therein electrical wiring and at least one electrical component selected front the group consisting of a ballast and a transformer.

37. The system of claim 36 wherein said sides of said lamp housing each comprise an endplate, said reflector attached to unit endplates.

38. The system of claim 36 wherein said lamp housing further comprises a lampholder attached to said reflector.

39. The system of claim 36 wherein said lamp housing further comprises a lampholder attached to one of said endplates.

40. The system of claim 31 wherein said enclosure comprises:

a longitudinal first portion; and a longitudinal second portion hinged to said first portion wherein:

in a first hinged position, said first and second portions form an enclosed longitudinal structure; and in a second hinged position, said first and second portions provide access to said enclosure's interior.

41. The system of claim 40 wherein said enclosure has two open ends in both said first and second hinged positions and further comprises first and second sidecovers, each sidecover dimensioned to cover a respective said open end.

42. The system of claim 40 wherein:

said first portion has a screw track running longitudinally inside of said enclosure; and said second portion has a screw track running longitudinally inside of said enclosure.

43. A lighting wet in comprising two luminaires, each said luminaire comprising:

a lamp housing comprising a reflector, said lamp housing having two sides opposite each other;

first and second arms each having first and second ends, each said arm attached at said first and to a respective side of said lamp housing, each said first end having a boss toward said lamp housing; and an enclosure positioned between said first and second arms adjacent said second ends; wherein:

said two luminaires are positioned side by side such that said first arm of one luminaire is adjacent said second arm of said other luminaire substantially along the entire lengths of said first and second arms.

44. The system of claim 43 wherein said boss provides screw head clearance between said arms and said lamp housing.

45. The system of claim 41 wherein said boss' allows the outer surfaces of said first arm of said one luminaire and said second arm of said other luminaire to be positioned side by mid, along their entire lengths without interference from fasteners.

46. The system of claim 43 wherein said first arm of said one luminaire is in contact with said second arm at said other luminaire substantially along the entire lengths of said first and second arms.

47. The system of claim 43 wherein said lamp housing is rotatable about an axis perpendicular to said first and second arms.

48. The system of claim 43 wherein said enclosure is in contact with said first and second arms at said second ends.

49. The system of claim 43 wherein said enclosure comprises:

a first portion; and a second hinged to said portion, said second portion forming an enclosed structure in a first hinged position and providing access to said enclosure's interior in a second hinged position.

50. The system of claim 43 wherein:

said first arm of said one luminaire is in contact with said second arm of said other luminaire.

* * * * *